US011244590B2

(12) United States Patent
Kim et al.

(10) Patent No.: US 11,244,590 B2
(45) Date of Patent: Feb. 8, 2022

(54) GAMMA VOLTAGE GENERATOR AND DISPLAY DEVICE

(71) Applicant: Samsung Display Co., Ltd., Yongin-si (KR)

(72) Inventors: Hun-Bae Kim, Anyang-si (KR); Yong-Gu Kang, Hwaseong-si (KR); Jihoon Kim, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 13 days.

(21) Appl. No.: 16/400,749

(22) Filed: May 1, 2019

(65) Prior Publication Data

US 2019/0355291 A1 Nov. 21, 2019

(30) Foreign Application Priority Data

May 17, 2018 (KR) ..... 10-2018-0056353

(51) Int. Cl.
*G09G 3/20* (2006.01)
*G09G 5/10* (2006.01)

(52) U.S. Cl.
CPC ..... *G09G 3/2003* (2013.01); *G09G 5/10* (2013.01); *G09G 2320/0233* (2013.01); *G09G 2320/0276* (2013.01)

(58) Field of Classification Search
CPC ..... B25J 9/1674; G02B 27/01; G02B 27/017; G05B 2219/39412; G06K 7/1417; G06K 9/00671; G06N 5/003; G06N 5/022; G06N 5/041; G06T 19/006; G07C 3/005; G07C 3/08
See application file for complete search history.

(56) References Cited

U.S. PATENT DOCUMENTS

| | | | | |
|---|---|---|---|---|
| 9,508,284 | B2 * | 11/2016 | Lim | G09G 3/3208 |
| 10,395,572 | B2 * | 8/2019 | Jee | G09G 3/3275 |
| 2013/0127923 | A1 * | 5/2013 | An | G09G 5/10 345/690 |
| 2016/0055831 | A1 * | 2/2016 | Kim | G09G 3/3283 345/212 |
| 2016/0155376 | A1 * | 6/2016 | Shin | G09G 3/3208 345/690 |

FOREIGN PATENT DOCUMENTS

| | | |
|---|---|---|
| KR | 10-2016-0059021 A | 5/2016 |
| KR | 10-2017-0014578 A | 2/2017 |

* cited by examiner

*Primary Examiner* — Ming Wu
(74) *Attorney, Agent, or Firm* — Lewis Roca Rothgerber Christie LLP

(57) ABSTRACT

A gamma voltage generator included in a display device includes a gamma reference voltage storage block configured to store gamma reference voltage values at reference gray levels, an additional offset storage block configured to store additional offset values for the gamma reference voltage values at the reference gray levels, an additional offset setting block configured to store gamma select information representing whether the additional offset values are to be applied or not, a gamma reference voltage calculation block configured to generate final gamma reference voltage values by selectively adding the additional offset values to the gamma reference voltage values depending on the gamma select information, and a gamma reference voltage generation block configured to generate gamma reference voltages corresponding to the final gamma reference voltage values.

17 Claims, 12 Drawing Sheets

FIG. 11

| LUMINANCE LEVEL | OFF RATIO | WEIGHT | FGRVV |
|---|---|---|---|
| 400 nit | 0% | 0 | DGRVV + OTPV |
| 301 nit | 13% | 0 | |
| 185 nit | 34% | 0 | |
| 34 nit | 41% | 0.5 | DGRVV + OTPV + 0.5 * AOV |
| 20 nit | 79% | 1 | DGRVV + OTPV + 1 * AOV |
| 2 nit | 99% | 1 | |

GAMMA VOLTAGE GENERATOR AND DISPLAY DEVICE

CROSS-REFERENCE TO RELATED APPLICATION(S)

This application claims priority to and the benefit of Korean Patent Applications No. 10-2018-0056353, filed on May 17, 2018 in the Korean Intellectual Property Office (KIPO), the contents of which are incorporated herein in its entirety by reference.

BACKGROUND

1. Field

Aspects of some example embodiments relate generally to display devices.

2. Description of the Related Art

Even if a plurality of display devices are manufactured by the same manufacturing process, the plurality of display devices may have difference luminance and/or color coordinate characteristics, and image quality characteristics of some display devices may not reach a target quality level because of deviations in the manufacturing process. Accordingly, a post-correction process for adjusting the image quality characteristic of the display device to reach the target quality level may be performed. Thus, a multi-time programming (MTP) operation for repeatedly performing the post-correction in luminance and color coordinate may be performed in order to adjust the image quality characteristic of each display device to reach the target quality level.

However, in order not to excessively increase a tact time of the MTP operation for each display device, the MTP operation may be performed only at a reference luminance level (or a reference dimming level). Thus, the image quality characteristic of each display device may be within a target range at the reference luminance level. However, the image quality characteristics of some display devices may exceed the target range at a luminance level (or a dimming level) where the MTP operation is not performed, or at a low luminance level, and these display devices may be discarded as defective products.

The above information disclosed in this Background section is only for enhancement of understanding of the background of the invention and therefore it may contain information that does not constitute prior art.

SUMMARY

Aspects of some example embodiments relate generally to display devices. For example, some example embodiments relate to gamma voltage generators and display devices including the gamma voltage generators.

Some example embodiments may include a gamma voltage generator capable of allowing a defective product to be converted into a fair quality product.

Some example embodiments may include a display device including the gamma voltage generator.

According to some example embodiments, a gamma voltage generator included in a display device includes a gamma reference voltage storage block configured to store gamma reference voltage values at reference gray levels, an additional offset storage block configured to store additional offset values for the gamma reference voltage values at the reference gray levels, an additional offset setting block configured to store gamma select information representing whether the additional offset values are to be applied or not, a gamma reference voltage calculation block configured to generate final gamma reference voltage values by selectively adding the additional offset values to the gamma reference voltage values depending on the gamma select information, and a gamma reference voltage generation block configured to generate gamma reference voltages corresponding to the final gamma reference voltage values.

In some example embodiments, the gamma reference voltage values stored in the gamma reference voltage storage block may be generated by a multi-time programming (MTP) operation at a reference luminance level for the display device.

In some example embodiments, the gamma reference voltage storage block may include a gamma register table configured to store default gamma reference voltage values that are common to a plurality of display devices manufactured by a same process as that used for the display device, and an one-time programming (OTP) value table configured to store differences between the default gamma reference voltage values and values searched by the MTP operation.

In some example embodiments, the additional offset storage block may include an additional offset table configured to store the additional offset values, and the additional offset values may be common to a plurality of display devices manufactured by a same process as that used for the display device.

In some example embodiments, the additional offset values may be predetermined to increase blue luminance or green luminance with respect to a defective display device having a reddish defect.

In some example embodiments, the additional offset storage block may include an additional offset table configured to store the additional offset values, and the additional offset values may be one of a plurality of additional offset value sets that are predetermined for a plurality of display devices manufactured by a same process as that used for the display device.

In some example embodiments, the plurality of additional offset value sets may include a first additional offset value set for increasing blue luminance or green luminance with respect to a defective display device having a reddish defect, and a second additional offset value set for increasing red luminance or green luminance with respect to a defective display device having a bluish defect.

In some example embodiments, the additional offset storage block may include an additional offset table configured to store the additional offset values that are generated by an additional MTP operation for the display device.

In some example embodiments, the additional MTP operation may be performed for each of defective display devices among a plurality of display devices manufactured by a same process as that used for the display device.

In some example embodiments, the additional MTP operation may be performed at at least one low luminance level that is lower than a reference luminance level at which an MTP operation for searching the gamma reference voltage values is performed.

In some example embodiments, the additional offset storage block may include a reddish defect additional offset table configured to store the additional offset values for increasing blue luminance or green luminance with respect to a defective display device having a reddish defect, and a bluish defect additional offset table configured to store the additional offset values for increasing red luminance or green luminance with respect to a defective display device having a bluish defect.

In some example embodiments, the gamma reference voltage calculation block may output the gamma reference voltage values as the final gamma reference voltage values when the gamma select information indicates that the additional offset values are not to be applied, and may output the gamma reference voltage values to which the additional offset values are added as the final gamma reference voltage values when the gamma select information indicates that the additional offset values are to be applied.

In some example embodiments, the gamma reference voltage calculation block may include an adder configured to calculate the final gamma reference voltage values, and a switch configured to selectively provide the additional offset values to the adder depending on the gamma select information.

In some example embodiments, the additional offset setting block may further store off ratio range information representing an off ratio range of the display device to which the additional offset values are applied.

In some example embodiments, when the gamma select information indicates that the additional offset values are to be applied, and a current off ratio of the display device is within the off ratio range indicated by the off ratio range information, the gamma reference voltage calculation block may generate the final gamma reference voltage values by adding the additional offset values to the gamma reference voltage values.

In some example embodiments, the additional offset setting block may further store weight information representing weights for the additional offset values.

In some example embodiments, when the gamma select information indicates that the additional offset values are to be applied, the gamma reference voltage calculation block may multiply the additional offset values by the weights, and may generate the final gamma reference voltage values by adding results of the multiplication to the gamma reference voltage values.

In some example embodiments, the weight information stored in the additional offset setting block may include a plurality of weights respectively corresponding to a plurality of off ratios. The gamma reference voltage calculation block may multiply the additional offset values by one of the plurality of weights corresponding to a current off ratio of the display device, and may generate the final gamma reference voltage values by adding results of the multiplication to the gamma reference voltage values.

According to some example embodiments, a display device including a display panel includes: pixels, a scan driver configured to provide scan signals to the pixels, an emission driver configured to provide emission control signals to the pixels, a gamma voltage generator configured to store gamma reference voltage values and additional offset values, to further store gamma select information representing whether the additional offset values are to be applied or not, and to generate gamma reference voltages corresponding to the gamma reference voltage values to which the additional offset values are selectively added depending on the gamma select information, and a data driver configured to generate data signals based on the gamma reference voltages, and to provide the data signals to the pixels.

In some example embodiments, the gamma voltage generator may include a gamma reference voltage storage block configured to store the gamma reference voltage values at reference gray levels, an additional offset storage block configured to store the additional offset values for the gamma reference voltage values at the reference gray levels, an additional offset setting block configured to store the gamma select information representing whether the additional offset values are to be applied or not, a gamma reference voltage calculation block configured to generate final gamma reference voltage values by selectively adding the additional offset values to the gamma reference voltage values depending on the gamma select information, and a gamma reference voltage generation block configured to generate the gamma reference voltages corresponding to the final gamma reference voltage values.

As described above, the gamma voltage generator and the display device according to example embodiments may store the gamma reference voltage values and the additional offset values, may further store the gamma select information representing whether the additional offset values are to be applied or not, and may generate the gamma reference voltages corresponding to the gamma reference voltage values to which the additional offset values are selectively added depending on the gamma select information. Accordingly, even if the display device is determined as a defective product, the defective product may be converted into a fair quality product by applying the additional offset values to the display device determined as the defective product. Therefore, a yield of the display device can be improved.

BRIEF DESCRIPTION OF THE DRAWINGS

Illustrative, non-limiting example embodiments will be more clearly understood from the following detailed description taken in conjunction with the accompanying drawings.

FIG. 11 is a diagram for describing an example where additional offset values are applied with different weights depending on an off ratio of a display device.

DETAILED DESCRIPTION

Figure 1:
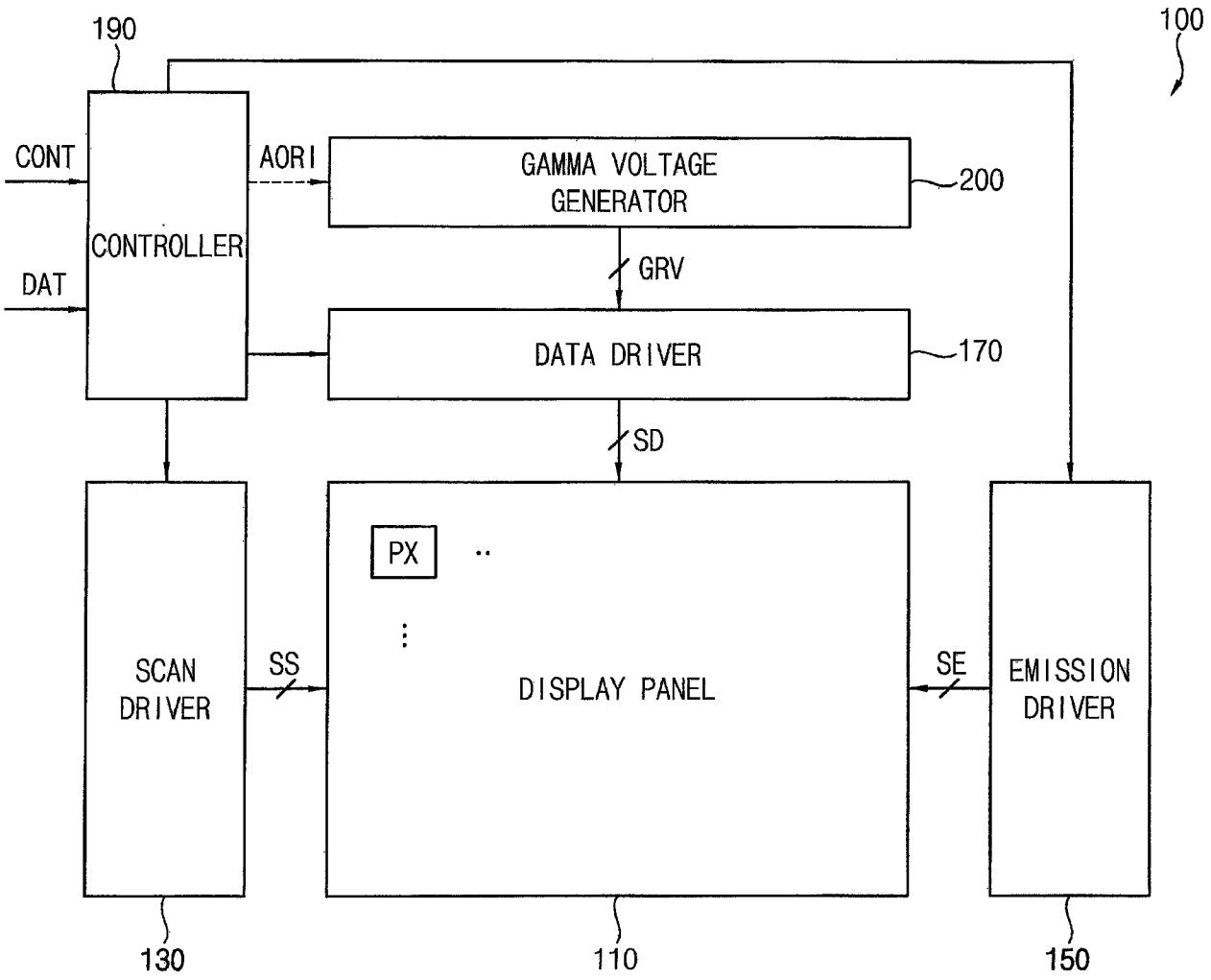
FIG. 1 is a block diagram illustrating a display device according to some example embodiments.

The example embodiments are described more fully hereinafter with reference to the accompanying drawings. Like or similar reference numerals refer to like or similar elements throughout.

FIG. 1 is a block diagram illustrating a display device according to some example embodiments.

Referring to FIG. 1, a display device 100 may include a display panel 110 including pixels PX, a scan driver 130 providing scan signals SS to the pixels PX, an emission driver 150 providing emission control signals SE to the pixels PX, a data driver 170 providing data signals SD to the pixels PX, and a gamma voltage generator 200 generating gamma reference voltages GRV. In some example embodiments, the display device 100 may further include a controller (e.g., a timing controller) 190 controlling the scan driver 130, the emission driver 150, the data driver 170 and the gamma voltage generator 200.

The display panel 110 may include a plurality of scan lines, a plurality of data lines, a plurality of emission control lines, and a plurality of pixels PX connected to the plurality of scan lines, the plurality of data lines and the plurality of emission control lines. In some example embodiments, each pixel PX may include an organic light emitting diode (OLED), and the display panel 110 may be, but not limited to, an OLED display panel. For example, the display panel 110 may be a liquid crystal display (LCD) panel, or the like.

The scan driver 130 may provide the scan signals SS to the pixels PX through the plurality of scan lines based on a first control signal received from the controller 190. In some example embodiments, the first control signal may include, but not limited to, a scan start signal and an input clock signal.

The emission driver 150 may provide the emission control signals SE to the pixels PX through the plurality of emission control lines based on a second control signal received from the controller 190. In some example embodiments, the emission control signals SE may be a global signal that is common to all the pixels PX. In other example embodiments, the emission control signals SE may be sequentially applied to the pixels PX on a row-by-row basis.

In some example embodiments, a ratio of an on period of the emission control signals SE to an emission period of each frame may be controlled depending on an off ratio of the display device 100. Here, the off ratio may be a ratio of a period in which the pixels PX do not emit light to each frame period (or the emission period of each frame), may be determined depending on a luminance level (or a dimming level) of the display device 100, and may be referred to as an active matrix OLED off ratio (AOR). For example, when the display device 100 operates at the highest luminance level (e.g., about 400 nit), the off ratio of the display device 100 may be about 0%, and the emission control signals SE may have an on level for the entire emission period of each frame. Further, when the display device 100 operates at the lowest luminance level (e.g., about 2 nit), the off ratio of the display device 100 may be about 99%, and the emission control signals SE may have the on level for about 99% of the emission period of each frame and an off level for about 1% of the emission period of each frame.

The data driver 170 may provide the data signals DS to the pixels PX through the plurality of data lines based on a third control signal and image data received from the controller 190. In some example embodiments, the third control signal may include, but not limited to, a horizontal start signal and a load signal. The data driver 170 may receive the gamma reference voltages (or gamma voltages) GRV from the gamma voltage generator 200, and may generate the data signals DS based on the gamma reference voltages GRV. For example, 256 gamma voltages at 256 gray levels (e.g., from 0-gray level to 255-gray level) may be generated based on the gamma reference voltages GRV at reference gray levels (e.g., 0-gray level, 1-gray level, 11-gray level, 23-gray level, 35-gray level, 51-gray level, 87-gray level, 151-gray level, 203-gray level and 255-gray level) selected among the 256 gray levels, and the data driver 170 output one of the 256 gamma voltages corresponding to a gray level indicated by the image data as the data signal SD.

The controller (e.g., the timing controller) 190 may receive image data DAT and a control signal CONT from an external host processor (e.g., a graphic processing unit (GPU) or a graphic card). In some example embodiments, the image data DAT may be RGB data including red image data, green image data and blue image data. In some example embodiments, the control signal CONT may include, but not limited to, a vertical synchronization signal, a horizontal synchronization signal, a master clock signal and a data enable signal. The controller 190 may control operations of the scan driver 130, the emission driver 150, the data driver 170 and the gamma voltage generator 200.

The gamma voltage generator 200 may provide the gamma reference voltages GRV to the data driver 170. The gamma voltage generator 200 may store gamma reference voltage values searched by a multi-time programming (MTP) operation at a reference luminance level. Further, the gamma voltage generator 200 may store not only the gamma reference voltage values, but also additional offset values that are selectively applied depending on gamma select information. In some example embodiments, the gamma select information of the display device 100 determined as a fair quality product may have a value indicating that the additional offset values are not to be applied, and the gamma select information of the display device 100 determined as a defective product may have a value indicating that the additional offset values are to be applied. Thus, the display device 100 determined as the fair quality product may generate the gamma reference voltages GRV corresponding to the gamma reference voltage values, and the display device 100 determined as the defective product may generate the gamma reference voltages GRV corresponding to the gamma reference voltage values to which the additional offset values are added. Accordingly, even if the display device 100 is determined as the defective product because the display device 100 has an image quality characteristic (e.g., a luminance characteristic and/or a color coordinate characteristic) that exceeds a target range at a luminance level or a dimming level (e.g., a low luminance level) at which the MTP operation is not performed, the additional offset values are applied with respect to the display device 100 determined as the defective product. Thus, the display device 100 to which the additional offset values are applied may have the image quality characteristic within the target range at the luminance level at which the MTP operation is not performed, and the display device 100 determined as the defective product may be converted into the fair quality product. As described above, since the display device 100 determined as the defective product may be converted into the fair quality product, a yield of the display device 100 can be improved.

In some example embodiments, the gamma voltage generator 200 may receive off ratio information AORI representing the off ratio of the display device 100 from the controller 190. The gamma voltage generator 200 may selectively the additional offset values based on the gamma select information and the off ratio information AORI. For example, when the gamma select information indicates that the additional offset values are to be applied, and a current off ratio of the display device 100 indicated by the off ratio information AORI is within an off ratio range (e.g., a predetermined off ratio range), the gamma voltage generator 200 may generate the gamma reference voltages RGV corresponding to the gamma reference voltage values to which the additional offset values are added.

In order to adjust the image quality characteristic of the display device 100 to reach a target quality level, the MTP operation for repeatedly performing a post-correction in luminance and color coordinate may be performed. However, the MTP operation may be performed only at a reference luminance level (or a reference dimming level) in order not to excessively increase a tact time of the MTP operation. Thus, although the image quality characteristic of the display device 100 may be within the target range at the reference luminance level, the image quality characteristic of the display device 100 may exceed the target range at the luminance level (or the dimming level) at which the MTP operation is not performed. For example, the MTP operation may be performed at the highest luminance level (e.g., about 400 nit), or at an off ratio of about 0%, and thus the image quality characteristic of the display device 100 may be within the target range at the highest luminance level corresponding to the off ratio of about 0%. However, the image quality characteristic of the display device 100 may exceed the target range at a low luminance level, e.g., about 2 nit corresponding to an off ratio of about 98%, and thus the display device 100 may be determined as the defective product. However, in the display device 100 determined as the defective product according to example embodiments, the additional offset values may be selectively applied depending on the off ratio of the display device 100. Accordingly, at a luminance level (or a dimming level) at which the image quality characteristic is within the target range, the additional offset values may not be applied, and the image quality characteristic may not be changed. At a luminance level (or a dimming level) at which the image quality characteristic exceeds the target range, the additional offset values may be applied, and the image quality characteristic, or the luminance characteristic and/or the color coordinate characteristic may be changed to be within the target range. Accordingly, without image degradation at the reference luminance level (e.g., a high luminance level), the image quality characteristic may be improved at the luminance level (e.g., a low luminance level) at which the image quality characteristic exceeds the target range, and thus the display device 100 determined as the defective product may be converted into the fair quality product, thereby improving the yield of the display device 100.

Figure 2:
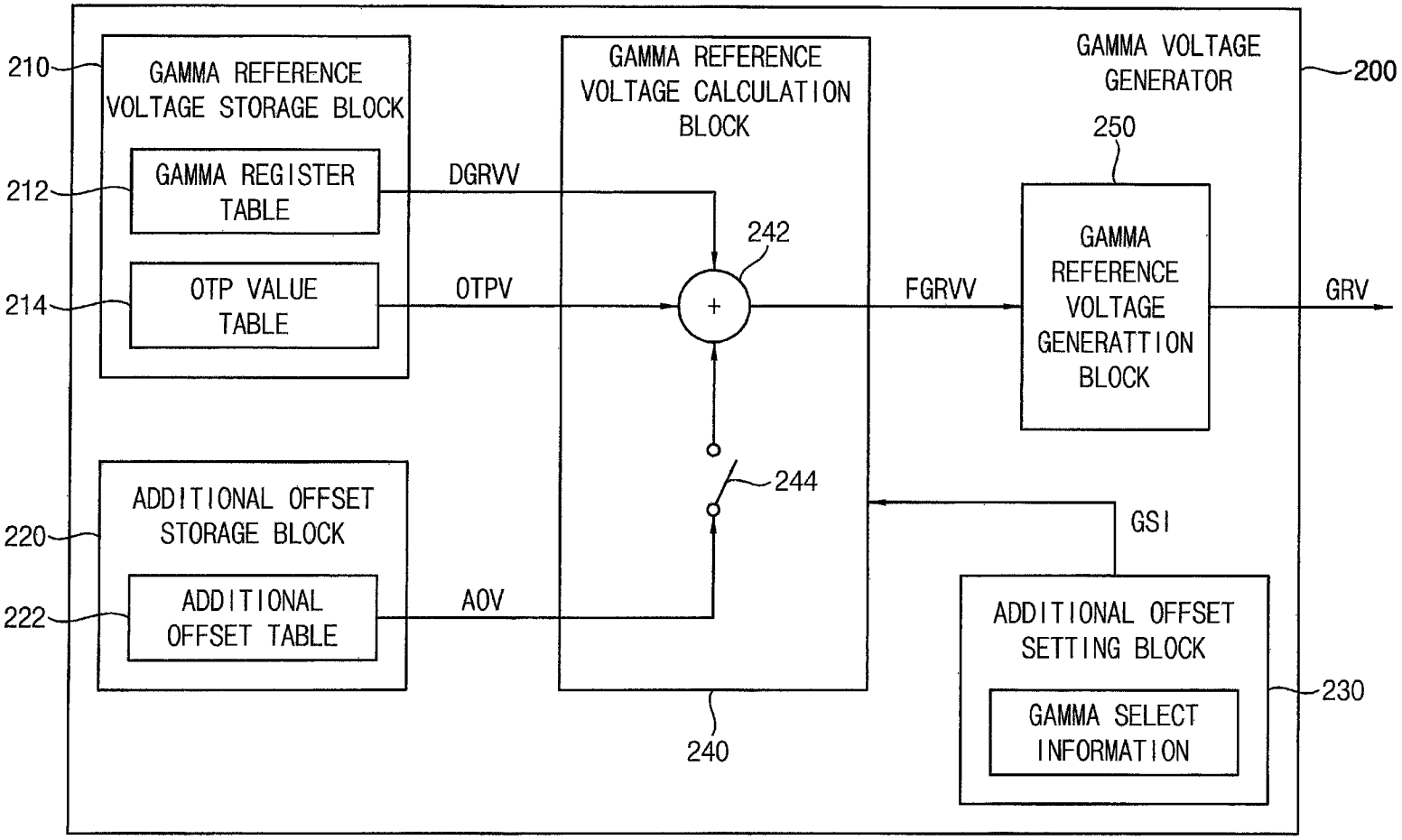
FIG. 2 is a block diagram illustrating a gamma voltage generator according to some example embodiments.
Figure 3:
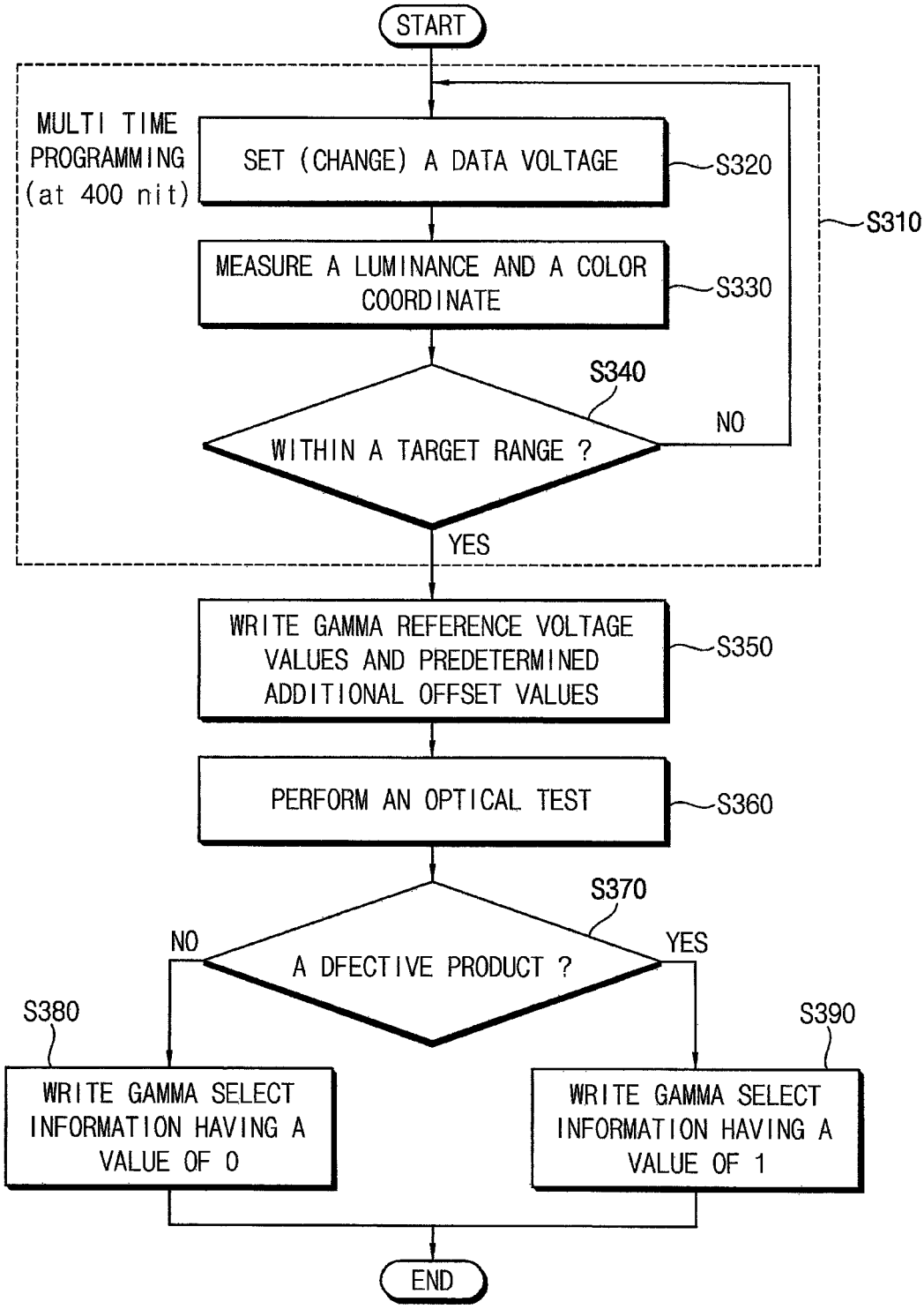
FIG. 3 is a flowchart illustrating an example of a method of writing additional offset values and gamma select information into a display device.
Figure 4:
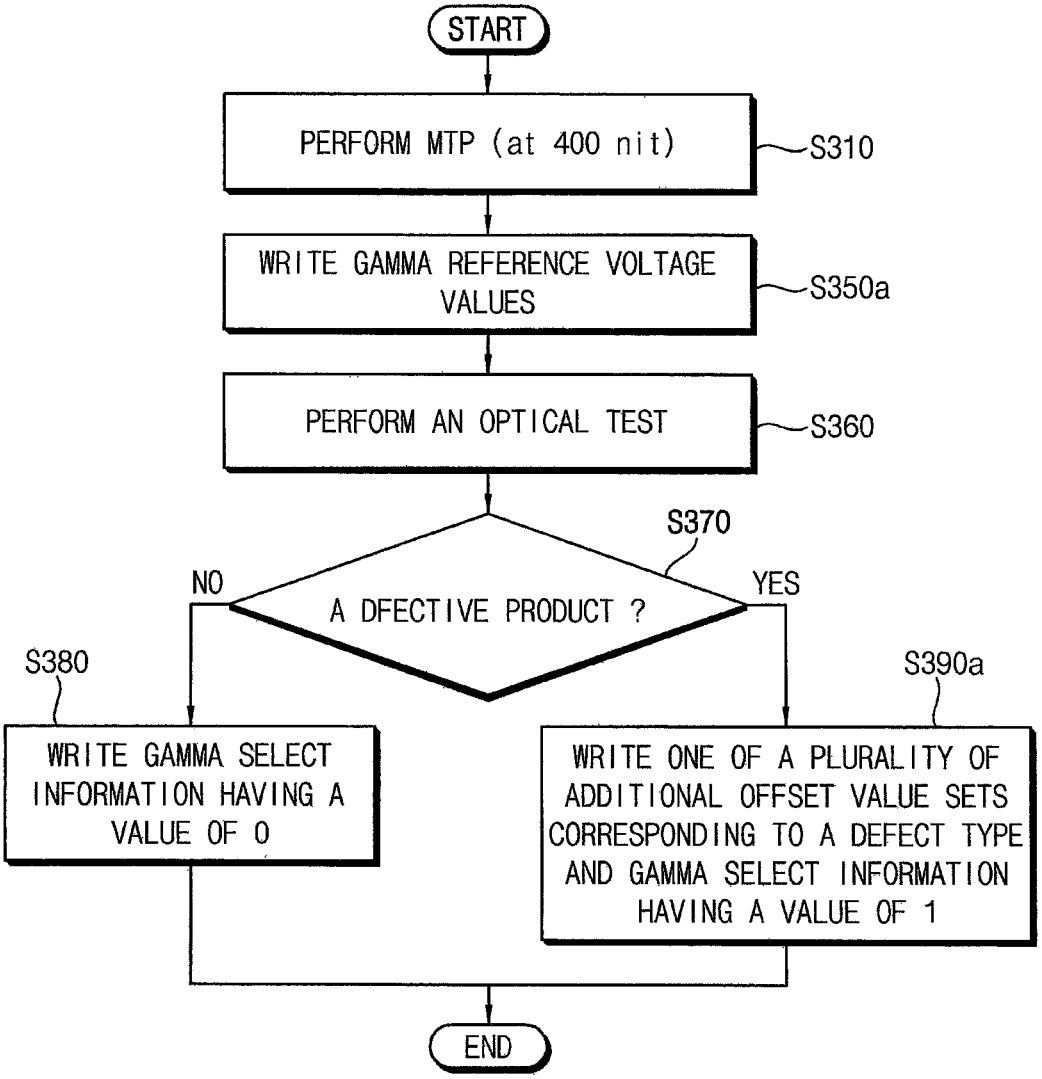
FIG. 4 is a flowchart illustrating another example of a method of writing additional offset values and gamma select information into a display device.
Figure 5:
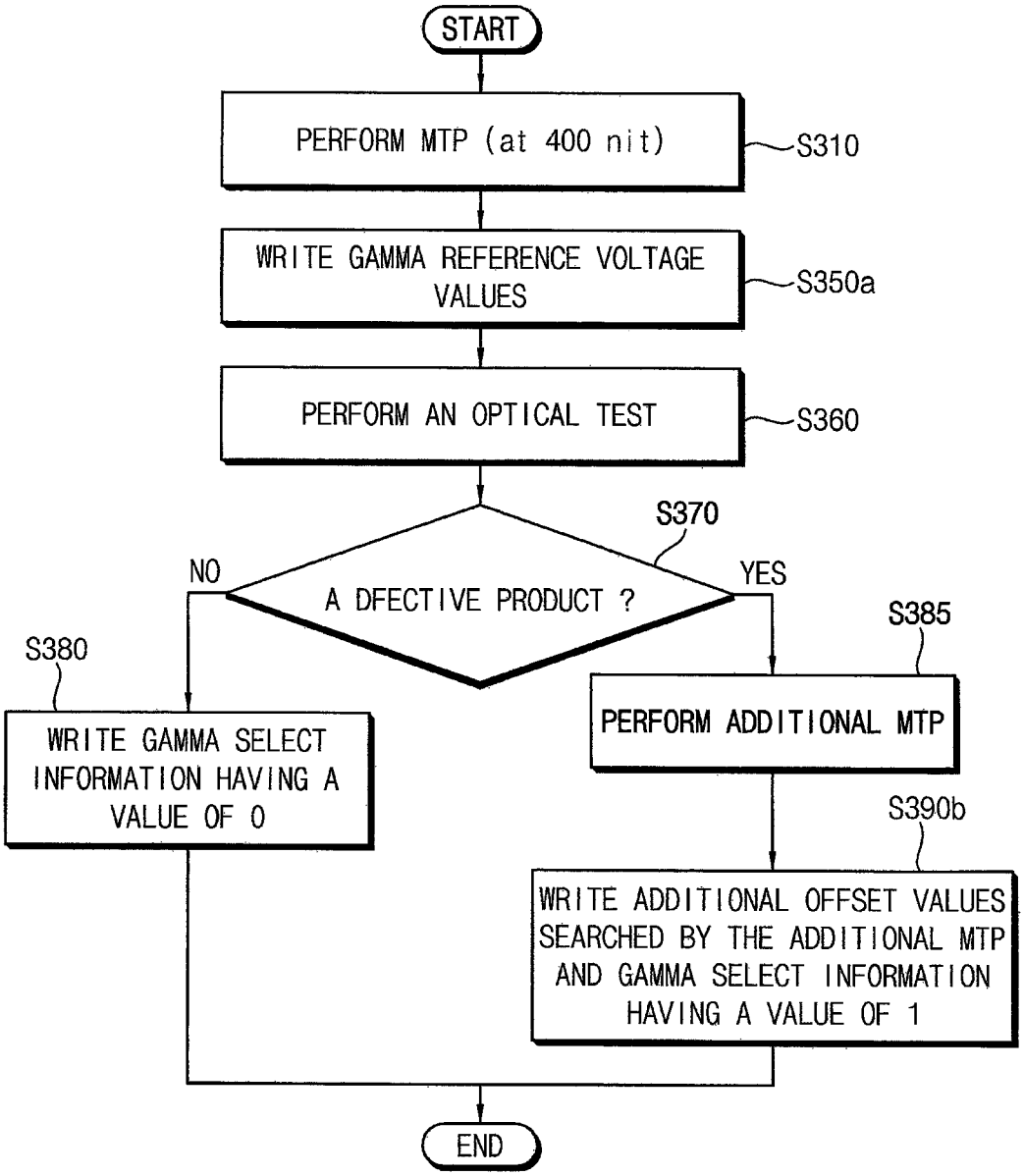
FIG. 5 is a flowchart illustrating still another example of a method of writing additional offset values and gamma select information into a display device.
Figure 6:
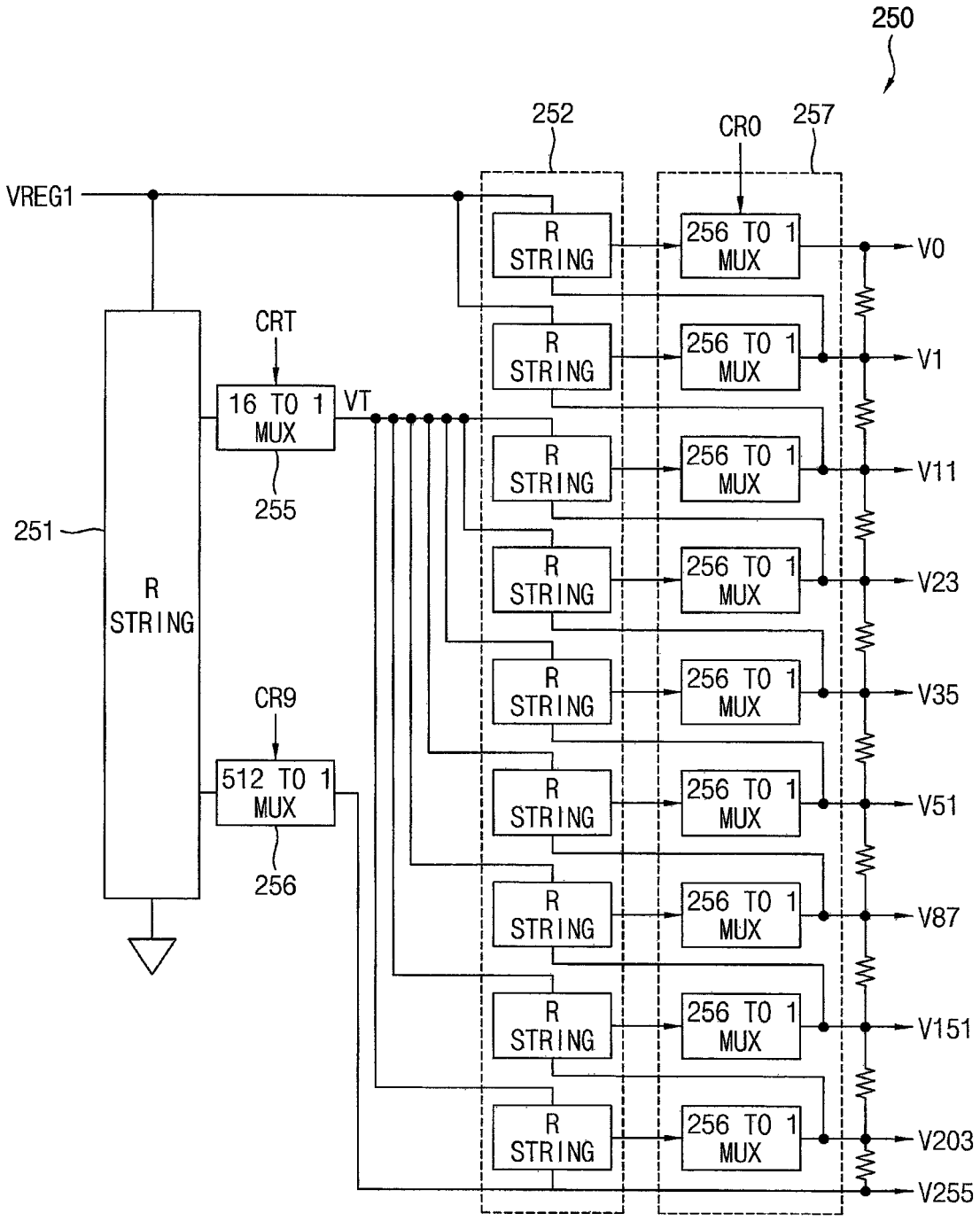
FIG. 6 is a block diagram illustrating an example of a gamma reference voltage generation block included in a gamma voltage generator according to some example embodiments.

FIG. 2 is a block diagram illustrating a gamma voltage generator according to example embodiments, FIG. 3 is a flowchart illustrating an example of a method of writing additional offset values and gamma select information into a display device, FIG. 4 is a flowchart illustrating another example of a method of writing additional offset values and gamma select information into a display device, FIG. 5 is a flowchart illustrating still another example of a method of writing additional offset values and gamma select information into a display device, and FIG. 6 is a block diagram illustrating an example of a gamma reference voltage generation block included in a gamma voltage generator according to example embodiments.

Referring to FIG. 2, a gamma voltage generator 200 included in a display device may include a gamma reference voltage storage block 210, an additional offset storage block 220, an additional offset setting block 230, a gamma reference voltage calculation block 240 and a gamma reference voltage generation block 250.

The gamma reference voltage storage block 210 may store gamma reference voltage values at reference gray levels. For example, the gamma reference voltage storage block 210 may store the gamma reference voltage values at the reference gray levels (e.g., 0-gray level, 1-gray level, 11-gray level, 23-gray level, 35-gray level, 51-gray level, 87-gray level, 151-gray level, 203-gray level and 255-gray level) selected among 256 gray levels (e.g., from 0-gray level to 255-gray level). In some example embodiments, the gamma reference voltage storage block 210 may store the gamma reference voltage values per each color. For example, the gamma reference voltage storage block 210 may store the gamma reference voltage for a red color, the gamma reference voltage for a blue color and the gamma reference voltage for a green color. In some example embodiments, the gamma reference voltage values stored in the gamma reference voltage storage block 210 may be generated (or searched) by an MTP operation at a reference luminance level for the display device. That is, the gamma reference voltage values may be determined by the MTP operation for repeatedly performing a post-correction in luminance and color coordinate to adjust an image quality characteristic of the display device to reach a target quality level.

In some example embodiments, the gamma reference voltage storage block 210 may store default gamma reference voltage values DGRVV that are common to a plurality of display devices manufactured by a same process as that used for the display device, and one-time programming (OTP) values OTPV corresponding to differences between the default gamma reference voltage values DGRVV and values searched by the MTP operation. For example, the gamma reference voltage storage block 210 may include a gamma register table 212 that stores the default gamma reference voltage values DGRVV that are common to the plurality of display devices manufactured by the same process, and an OTP value table 214 that stores OTP values OTPV corresponding to the differences between the default gamma reference voltage values DGRVV and the values searched by the MTP operation. In this case, the gamma reference voltage values searched by the MTP operation may correspond to sums of the default gamma reference voltage values DGRVV stored in the gamma register table 212 and the OTP values OTPV stored in the OTP value table 214.

The additional offset storage block 220 may store additional offset values AOV for the gamma reference voltage values at the reference gray levels. In some example embodiments, the additional offset storage block 220 may include an additional offset table 222 that stores the additional offset values AOV.

The additional offset setting block 230 may store gamma select information GSI representing whether the additional offset values AOV are to be applied or not. For example, the gamma select information GSI having a value of 0 may indicate that the additional offset values AOV are not to be applied, and the gamma select information GSI having a value of 1 may indicate that the additional offset values AOV are to be applied.

In some example embodiments, the additional offset values AOV stored in the additional offset table 222 may be common to the plurality of display devices manufactured by the same process as that used for the display device. That is, the same additional offset values AOV may be stored in the plurality of display devices manufactured by the same process.

For example, as illustrated in FIG. 3, an MTP operation for determining the gamma reference voltage values at the reference gray levels may be performed by repeatedly performing an data voltage adjustment and a luminance/color coordinate measurement with respect to each of the reference gray levels (e.g., 0-gray level, 1-gray level, 11-gray level, 23-gray level, 35-gray level, 51-gray level, 87-gray level, 151-gray level, 203-gray level and 255-gray level) at the reference luminance level (e.g., the highest luminance level of about 400 nit) (S310). The MTP operation may be performed with respect to each of the plurality of display devices manufactured by the same process. In some example embodiments, the MTP operation may be performed when each display device is in a module state where the display device may be a display panel scribed from a substrate (e.g., a one-sheet substrate) on which a plurality of display panels are formed.

For example, to perform the MTP operation (S310), a data voltage at each reference gray level may be set to a predicted gamma reference voltage value (S320), a luminance and/or a color coordinate of the display device that emits light in response to the set data voltage may be measured (S330), and it may be determined whether the measured luminance and/or the measured color coordinate are within a desired target range (S340). If the measured luminance and/or the measured color coordinate exceed the target range (S340: NO), the data voltage may be changed (S320), and the luminance and/or the color coordinate of the display device that emits light in response to the changed data voltage may be measured again (S330). If the measured luminance and/or the measured color coordinate are within the target range (S340: YES), a value of the data voltage applied to the display device at this time may be determined as the gamma reference voltage value. The determination of the gamma reference voltage value may be performed with respect to a plurality of reference gray levels per each color.

The gamma reference voltage values searched by the MTP operation (S310) may be written to the gamma reference voltage storage block 210, and additional offset values (e.g., predetermined additional offset values) AOV that are common to a plurality of display devices manufactured by the same process as that used for the display device may be written to the additional offset storage block 220 (S350). For example, the additional offset values AOV may be predetermined to increase blue luminance or green luminance with respect to a defective display device having a reddish defect, but may not be limited thereto. With respect to the display device on which the MTP operation (S310) is performed, or with respect to the display device to which the gamma reference voltage values searched by the MTP operation (S310) are applied, an optical test may be performed (S360). The optical test may be performed not only at the reference luminance level (e.g., about 400 nit) at which the MTP operation (S310) is performed, but also at least one luminance level (or at least one dimming level) at which the MTP operation (S310) is not performed. Thus, in some cases, an image quality characteristic of the display device may be within the target range at the reference luminance level, but may exceed the target range at the luminance level (or the dimming level) at which the MTP operation (S310) is not performed. In this case, the display device may be determined as a defective product.

If the display device is determined by the optical test (S360) as a fair quality product (S370: NO), the gamma select information GSI having a value of 0 indicating that the additional offset values AOV are not to be applied may be written to the additional offset setting block 230 of the display device determined as the fair quality product (S380). Accordingly, the additional offset values AOV may not be applied in the display device determined as the fair quality product, and thus the image quality characteristic of the display device determined as the fair quality product may not be changed.

If the display device is determined by the optical test (S360) as the defective product (S370: YES), the gamma select information GSI having a value of 1 indicating that the additional offset values AOV are to be applied may be written to the additional offset setting block 230 of the display device determined as the defective product (S390). Accordingly, the image quality characteristic of the display device determined as the defective product may not be improved, and the display device determined as the defective product may be converted into the fair quality product. For example, the additional offset values AOV predetermined to increase blue luminance or green luminance may be applied in a defective display device having a reddish defect, and the defective display device may be converted into the fair quality product since the reddish defect may be repaired by the additional offset values AOV.

Although FIG. 3 illustrates an example where, after the gamma reference voltage values are written (S350), the optical test may be performed (S360), in some example embodiments, the optical test may be performed before the gamma reference voltage values are written. In this case, the gamma reference voltage values searched by the MTP operation (S310) may be applied such that, during the optical test, a test equipment performing the optical test may apply data voltages corresponding to the gamma reference voltage values to the display device. For example, the gamma reference voltage values (and the predetermined additional offset values) may be written at substantially the same when the gamma select information GSI is written. In this case, the number of write operations for the display device may be reduced.

In other example embodiments, the additional offset values AOV may be one of a plurality of additional offset value sets that are predetermined for the plurality of display devices manufactured by the same process. For example, the plurality of additional offset value sets may include a first additional offset value set for increasing blue luminance or green luminance with respect to a defective display device having a reddish defect, and a second additional offset value set for increasing red luminance or green luminance with respect to a defective display device having a bluish defect.

For example, as illustrated in FIG. 4, the MTP operation may be performed at the reference luminance level (e.g., the highest luminance level of about 400 nit) (S310). The gamma reference voltage values searched by the MTP operation (S310) may be written to the gamma reference voltage storage block 210 (S350*a*). With respect to the display device on which the MTP operation (S310) is performed, or with respect to the display device to which the gamma reference voltage values searched by the MTP operation (S310) are applied, the optical test may be performed (S360). If the display device is determined by the optical test (S360) as the fair quality product (S370: NO), the gamma select information GSI having the value of 0 indicating that the additional offset values AOV are not to be applied may be written to the additional offset setting block 230 of the display device determined as the fair quality product (S380).

If the display device is determined by the optical test (S360) as the defective product (S370: YES), one of the plurality of additional offset value sets corresponding to a defect type of the display device may be written as the additional offset values AOV to the additional offset storage block 220 of the display device determined as the defective product, and the gamma select information GSI having the value of 1 indicating that the additional offset values AOV are to be applied may be written to the additional offset setting block 230 of the display device determined as the defective product (S390*a*).

For example, the plurality of additional offset value sets may include the first additional offset value set for increasing blue luminance or green luminance and the second additional offset value set for increasing red luminance or green luminance, the first additional offset value set may be written to the additional offset storage block 220 of a defective display device having a reddish defect, and the second additional offset value set may be written to the additional offset storage block 220 of a defective display device having a bluish defect. Thus, the reddish defect may be repaired by applying the first additional offset value set to the defective display device having the reddish defect, and the bluish defect may be repaired by applying the second additional offset value set to the defective display device having the bluish defect. Accordingly, the image quality characteristic of the display device determined as the defective product may be improved, and the display device determined as the defective product may be converted into the fair quality product, which results in the improvement of the yield of the display device.

In still other example embodiments, the additional offset values AOV stored in the additional offset table 222 may be searched by an additional MTP operation for the display device. In some example embodiments, the additional MTP operation may performed at one or more low luminance levels that are lower than the reference luminance level (e.g., about 400 nit) at which the MTP operation for searching the gamma reference voltage values is performed. That is, because the image quality characteristic of each display device may be within the target range at the reference luminance level because of the MTP operation performed at the reference luminance level, the additional MTP operation may be performed at a luminance level different from the reference luminance level, e.g., the low luminance level. Further, in some example embodiments, the additional MTP operation may be performed for each of defective display devices among the plurality of display devices manufactured by the same process. That is, the additional MTP operation may not be performed for the display device determined as the fair quality product, the additional MTP operation may be performed for the display device determined as the defective product, and thus the number of the additional MTP operations may be reduced.

For example, as illustrated in FIG. 5, the MTP operation may be performed at the reference luminance level (e.g., the highest luminance level of about 400 nit) (S310). The gamma reference voltage values searched by the MTP operation (S310) may be written to the gamma reference voltage storage block 210 (S350*a*). With respect to the display device on which the MTP operation (S310) is performed, or with respect to the display device to which the gamma reference voltage values searched by the MTP operation (S310) are applied, the optical test may be performed (S360). If the display device is determined by the optical test (S360) as the fair quality product (S370: NO), the gamma select information GSI having the value of 0 indicating that the additional offset values AOV are not to be applied may be written to the additional offset setting block 230 of the display device determined as the fair quality product (S380).

If the display device is determined by the optical test (S360) as the defective product (S370: YES), the additional MTP operation may be performed for the display device determined as the defective product. In some example embodiments, the additional MTP operation may be performed at a luminance level at which the display device may be determined by the optical test (S360) to have an image degradation, for example at one or more low luminance levels that are lower than the reference luminance level (e.g., about 400 nit) at which the MTP operation (S310) is performed. After the additional MTP operation (S385), the additional offset values AOV searched by the additional MTP operation may be written to the additional offset storage block 220 of the display device determined as the defective product, and the gamma select information GSI having the value of 1 indicating that the additional offset values AOV are to be applied may be written to the additional offset setting block 230 of the display device determined as the defective product (S390*b*). As described above, because the additional MTP operation may be performed for each display device determined as the defective product, the additional offset values AOV suitable for each defective display device may be searched. Further, because the additional offset values AOV searched by the additional MTP operation may be applied in each defective display device, the defective display device may be converted into the fair quality product, which results in the improvement of the yield of the display device.

Referring again to FIG. 2, the gamma reference voltage calculation block 240 may generate final gamma reference voltage values FGRVV by selectively adding the additional offset values to the gamma reference voltage values (i.e., the sums of the default gamma reference voltage values DGRVV and the OTP values OTPV) depending on the gamma select information GSI stored in the additional offset setting block 230. For example, the gamma reference voltage calculation block 240 may output the gamma reference voltage values (i.e., DGRVV+OTPV) stored in the gamma reference voltage storage block 210 as the final gamma reference voltage values FGRVV when the gamma select information GSI has the value of 0 indicating that the additional offset values AOV are not to be applied, and may output the gamma reference voltage values (i.e., DGRVV+OTPV+AOV) to which the additional offset values AOV are added as the final gamma reference voltage values FGRVV when the gamma select information GSI has the value of 1 indicating that the additional offset values AOV are to be applied.

In some example embodiments, the gamma reference voltage calculation block 240 may include an adder 242 that calculates the final gamma reference voltage values FGRVV, and a switch 244 that selectively provides the additional offset values AOV to the adder 242 depending on the gamma select information GSI. For example, when the gamma select information GSI has the value of 0 indicating that the additional offset values AOV are not to be applied, the switch 244 may be turned off not to provide the additional offset values AOV to the adder 242, and the adder 242 may calculate the final gamma reference voltage values FGRVV by summing the default gamma reference voltage values DGRVV and the OTP values OTPV. In another example, when the gamma select information GSI has the value of 1 indicating that the additional offset values AOV are to be applied, the switch 244 may be turned on to provide the additional offset values AOV to the adder 242, and the adder 242 may calculate the final gamma reference voltage values FGRVV by summing the default gamma reference voltage values DGRVV, the OTP values OTPV and the additional offset values AOV.

The gamma reference voltage generation block 250 may generate the gamma reference voltages GRV corresponding to the final gamma reference voltage values FGRVV provided from the gamma reference voltage calculation block 240. In some example embodiments, as illustrated in FIG. 5, the gamma reference voltage generation block 250 may include resistor strings 251 and 252 and selecting circuits 255, 256 and 257 to generate gamma reference voltages V0, V1, V11, V23, V35, V51, V87, V151, V203 and V255 having the final gamma reference voltage values FGRVV in response to control signals CRT, CR0 and CR9 corresponding to the final gamma reference voltage values FGRVV.

For example, a first resistor string 251 may divide a reference voltage VREG1. The first resistor string 251 may include resistors connected in series between the reference voltage VREG1 and a ground voltage. A first selecting circuit 255 may select one of outputs of the first resistor string 251 based on a bottom control signal CRT, and may output the selected one as a bottom voltage VT. For example, the first selecting circuit 255 may be implemented with a 16-to-1 multiplexer. A second selecting circuit 256 may select one of the outputs of the first resistor string 251 based on a tenth control signal CR9, and may output the selected one as a tenth gamma reference voltage V255. For example, the second selecting circuit 256 may be implemented with a 512-to-1 multiplexer.

A second resistor string 252 may include first through ninth sub-resistor strings, and a third selecting circuit 257 may include first through ninth sub-selectors. For example, each of the first through ninth sub-selectors may be implemented with a 256-to-1 multiplexer. With respect to a ninth gamma reference voltage V203, the ninth sub-resistor string may divide between the bottom voltage VT and the tenth gamma reference voltage V255, and the ninth sub-selector may select and output one of outputs of the ninth sub-resistor based on a ninth control signal. Similarly, the eighth sub-resistor string may divide between the bottom voltage VT and the ninth gamma reference voltage V203, and the eighth sub-selector may select and output one of outputs of the eighth sub-resistor as an eighth gamma reference voltage V151 based on an eighth control signal. That is, an i-th sub-resistor string may divide between the bottom voltage VT and an (i+1)-th gamma reference voltage, and an i-th sub-selector may select and output one of outputs of the i-th sub-resistor as an i-th gamma reference voltage based on an i-th control signal, where i is an integer greater than 2 and less than 10. With respect to a second gamma reference voltage V1, a second sub-resistor string may divide between the reference voltage VREG1 and a third gamma reference voltage V11, and a second sub-selector may select and output one of outputs of the second sub-resistor based on a second control signal. Similarly, a first sub-resistor string may divide between the reference voltage VREG1 and the second gamma reference voltage V1, and a first sub-selector may select and output one of outputs of the first sub-resistor as a first gamma reference voltage V0 based on a first control signal CR0.

In some example embodiments, the gamma reference voltage generation block 250 may further include a circuit for generating 256 gamma voltages at 256 gray levels (e.g., from 0-gray level to 255-gray level) by dividing, for example, 10 gamma reference voltages V0, V1, V11, V23, V35, V51, V87, V151, V203 and V255, and may provide the 256 gamma voltages generated based on the gamma reference voltages GRV to a data driver.

As described above, the gamma voltage generator 200 according to example embodiments may store the additional offset values AOV as well as the gamma reference voltage values (i.e., DGRVV+OTPV) searched by the MTP operation, and may generate the gamma reference voltages GRV corresponding to the gamma reference voltage values to which the additional offset values AOV are selectively added depending on the gamma select information GSI. Accordingly, even if the display device is determined as a defective product, the additional offset values AOV are applied in the display device determined as the defective product, and thus the display device determined as the defective product may be converted into a fair quality product, which results in an improvement of a yield of the display device.

Figure 7:
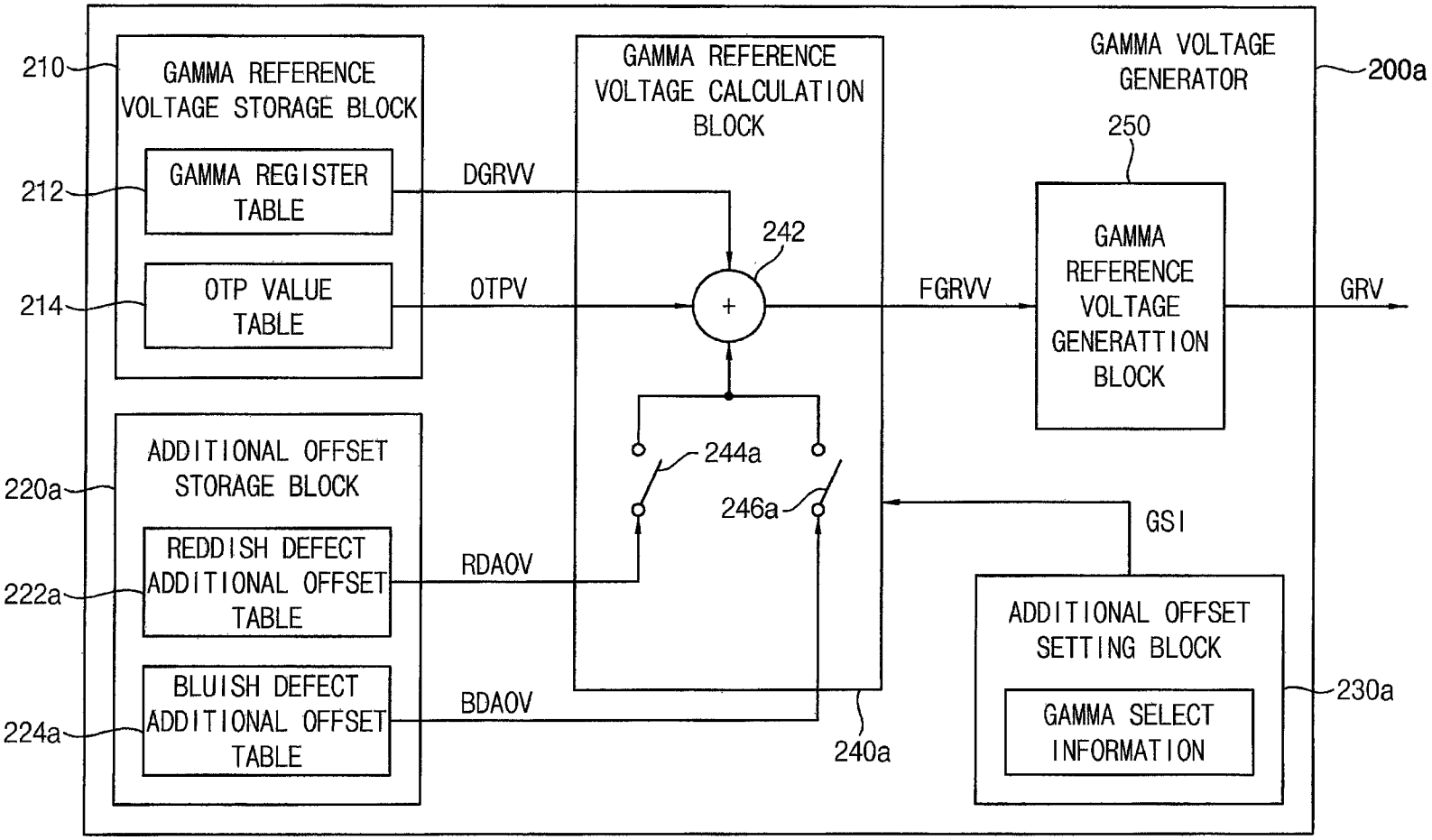
FIG. 7 is a block diagram illustrating a gamma voltage generator according to some example embodiments.

FIG. 7 is a block diagram illustrating a gamma voltage generator according to some example embodiments.

A gamma voltage generator 200*a* of FIG. 7 may have a similar operation and a similar configuration to a gamma voltage generator 200 of FIG. 2, except that an additional offset storage block 220*a* may include a plurality of additional offset tables 222*a* and 224*a*, an additional offset setting block 230*a* may store gamma select information GSI representing whether a plurality of additional offset value sets RDAOV and BDAOV stored in the plurality of additional offset tables 222*a* and 224*a* are to be applied or not, and a gamma reference voltage calculation block 240*a* may include a plurality of switches 244*a* and 246*a* for selectively providing the plurality of additional offset value sets RDAOV and BDAOV, respectively.

Referring to FIG. 7, the additional offset storage block 220*a* may include two or more additional offset tables 222*a* and 224*a*. In some example embodiments, as illustrated in FIG. 7, the additional offset storage block 220*a* may include a reddish defect additional offset table 222*a* that stores additional offset values RDAOV for increasing blue luminance or green luminance with respect to a defective display device having a reddish defect, and a bluish defect additional offset table 224*a* that stores additional offset values BDAOV for increasing red luminance or green luminance with respect to a defective display device having a bluish defect.

The gamma select information GSI stored in the additional offset setting block 230*a* may represent whether each of the plurality of additional offset value sets RDAOV and BDAOV stored in the plurality of additional offset tables 222*a* and 224*a* is to be applied or not. For example, the gamma select information GSI may have a value of '10' indicating that the additional offset values RDAOV stored in the reddish defect additional offset table 222*a* are to be applied, may have a value of '01' indicating that the additional offset values BDAOV stored in the bluish defect additional offset table 224*a* are to be applied, or may have a value of '00' indicating that all the additional offset values RDAOV and BDAOV are not to be applied.

The gamma reference voltage calculation block 240*a* may include a plurality of switches 244*a* and 246*a* for selectively providing the plurality of additional offset value sets RDAOV and BDAOV, respectively. For example, the gamma reference voltage calculation block 240*a* may include a first switch 244*a* for providing the additional offset values RDAOV stored in the reddish defect additional offset table 222*a* to an adder 242, and a second switch 246*a* for providing the additional offset values BDAOV stored in the bluish defect additional offset table 224*a* to the adder 242.

In a case where a display device is determined as a fair quality product, the gamma select information GSI may have the value of '00' indicating that all the additional offset values RDAOV and BDAOV are not to be applied, and the gamma reference voltage calculation block 240*a* may output gamma reference voltage values (i.e., DGRVV+OTPV) stored in a gamma reference voltage storage block 210 as final gamma reference voltage values FGRVV by turning off all of the first and second switches 244*a* and 246*a*. Accordingly, an image quality characteristic of the display device determined as the fair quality product may not be changed.

In a case where a display device has a reddish defect, the gamma select information GSI may have the value of '10' indicating that the additional offset values RDAOV stored in the reddish defect additional offset table 222*a* are to be applied, and the gamma reference voltage calculation block 240*a* may generate the final gamma reference voltage values FGRVV by adding the additional offset values RDAOV stored in the reddish defect additional offset table 222*a* to the gamma reference voltage values (i.e., DGRVV+OTPV) stored in the gamma reference voltage storage block 210. The display device may display an image based on gamma reference voltages GRV having the final gamma reference voltage values FGRVV. In this case, the reddish defect may be repaired, and the display device may be converted into the fair quality product.

Further, in a case where a display device has a bluish defect, the gamma select information GSI may have the value of '01' indicating that the additional offset values BDAOV stored in the bluish defect additional offset table 224*a* are to be applied, and the gamma reference voltage calculation block 240*a* may generate the final gamma reference voltage values FGRVV by adding the additional offset values BDAOV stored in the bluish defect additional offset table 224*a* to the gamma reference voltage values (i.e., DGRVV+OTPV) stored in the gamma reference voltage storage block 210. The display device may display an image based on the gamma reference voltages GRV having the final gamma reference voltage values FGRVV. In this case, the bluish defect may be repaired, and the display device may be converted into the fair quality product.

Figure 8:
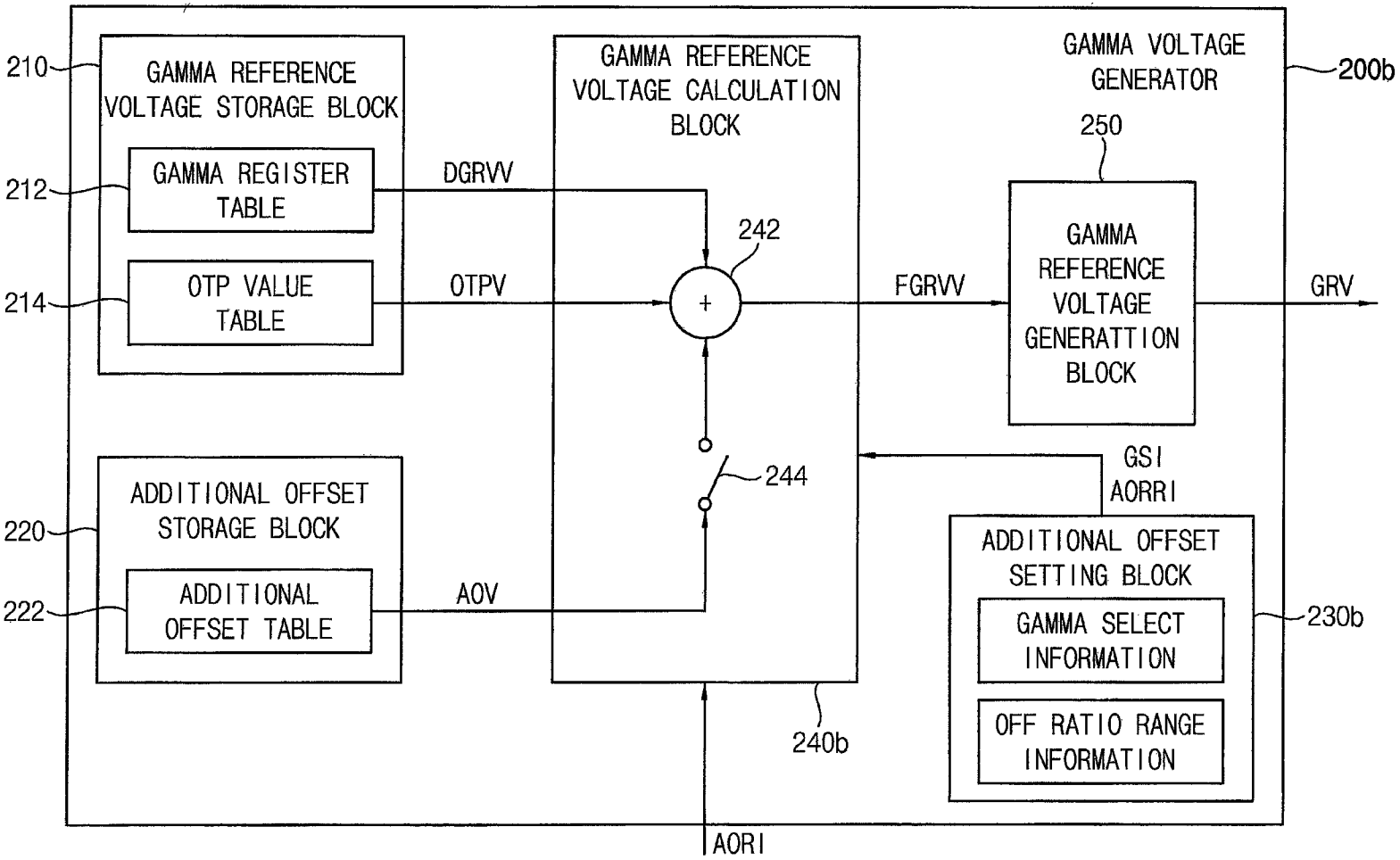
FIG. 8 is a block diagram illustrating a gamma voltage generator according to some example embodiments.
Figure 9:
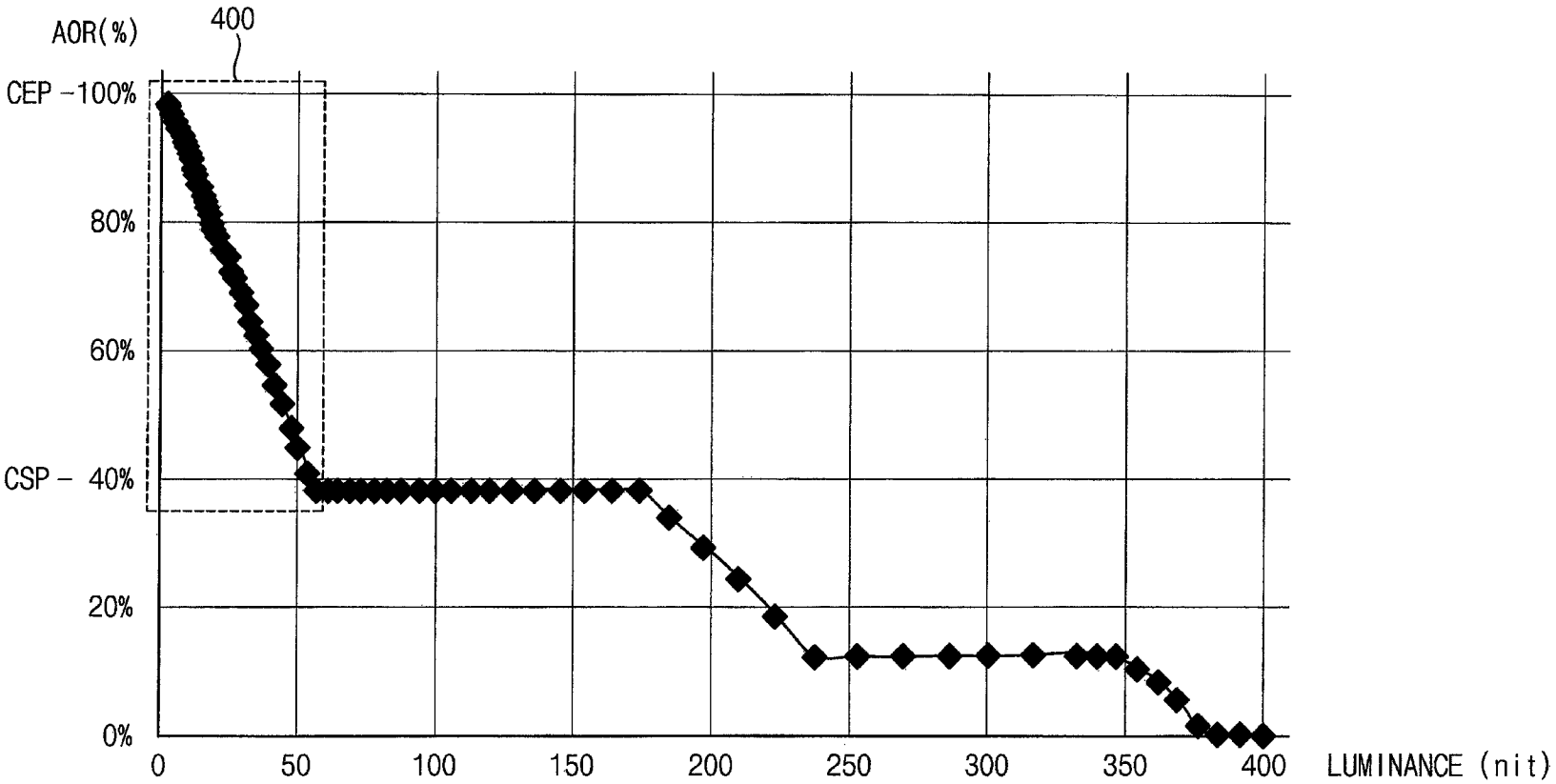
FIG. 9 is a diagram for describing an example where additional offset values are selectively applied depending on an off ratio of a display device.

FIG. 8 is a block diagram illustrating a gamma voltage generator according to example embodiments, and FIG. 9 is a diagram for describing an example where additional offset values are selectively applied depending on an off ratio of a display device.

A gamma voltage generator 200*b* of FIG. 8 may have a similar operation and a similar configuration to a gamma voltage generator 200 of FIG. 2, except that an additional offset setting block 230*b* may store, as well as gamma select information GSI, off ratio range information AORRI representing an off ratio range of a display device to which additional offset values AOV are applied, and a gamma reference voltage calculation block 240*b* may receive off ratio information AORI about a current off ratio of the display device from a controller, and may apply the additional offset values AOV when the current off ratio of the display device is within the off ratio range indicated by the off ratio range information AORRI.

Referring to FIG. 8, the off ratio range information AORRI stored in the additional offset setting block 230*b* may represent the off ratio range of the display device to which the additional offset values AOV are applied. For example, the off ratio range information AORRI may include a start point CSP and an end point CEP of the off ratio range to which the additional offset values AOV are applied. When the gamma select information GSI indicates that the additional offset values AOV are to be applied, and the current off ratio indicated by the off ratio information AORI from the controller is within the off ratio range indicated by the off ratio range information AORRI, the gamma reference voltage calculation block 240*b* may generate final gamma reference voltage values FGRVV by adding the additional offset values AOV to gamma reference voltage values (i.e., DGRVV+OTPV) stored in a gamma reference voltage storage block 210.

For example, as illustrated in FIG. 9, the additional offset setting block 230*b* may store, as the off ratio range information AORRI, the start point CSP indicating an off ratio of about 40% and the end point CEP indicating an off ratio of about 100%, and the gamma reference voltage calculation block 240*b* may apply the additional offset values AOV when the gamma select information GSI indicates that the additional offset values AOV are to be applied, and the current off ratio indicated by the off ratio information AORI is within the off ratio range from about 40% to about 100%. Even if a display device is determined as a defective product, since an MTP operation is performed at a reference luminance level (e.g., the highest luminance level), an image quality characteristic of the display device may be within a desired target range at a high luminance level corresponding to a low off ratio. Thus, although the gamma select information GSI indicates that the additional offset values AOV are to be applied, the gamma voltage generator 200*b* may not apply the additional offset values AOV using the off ratio range information AORRI at the high luminance level, or at the low off ratio where the image quality characteristic is within the target range, and thus the image quality characteristic may not be changed. However, at a low luminance level corresponding to a high off ratio where the image quality characteristic exceeds the target range, the gamma voltage generator 200*b* may apply the additional offset values AOV using the off ratio range information AORRI, thereby improving the image quality characteristic to be within the target range.

As described above, the gamma voltage generator 200*b* may apply the additional offset values AOV only at a luminance level (or only at an off ratio corresponding to the luminance level) where the image quality characteristic exceeds the target range by using the off ratio range information AORRI. Accordingly, the image quality characteristic may not be changed at a luminance level (or a dimming level) where the image quality characteristic is within the target range since the additional offset values AOV are not applied at the luminance level, and, at a luminance level (or a dimming level) where the image quality characteristic exceeds the target range, the image quality characteristic not be improved such that the image quality characteristic, or a luminance characteristic and/or a color coordinate characteristic is within the target range since the additional offset values AOV are applied at the luminance level. Accordingly, without image degradation at the reference luminance level (e.g., the high luminance level), the image quality characteristic may be improved at the luminance level (e.g., the low luminance level) at which the image quality characteristic exceeds the target range, and thus the display device determined as a defective product may be converted into a fair quality product, thereby improving a yield of the display device.

Figure 10:
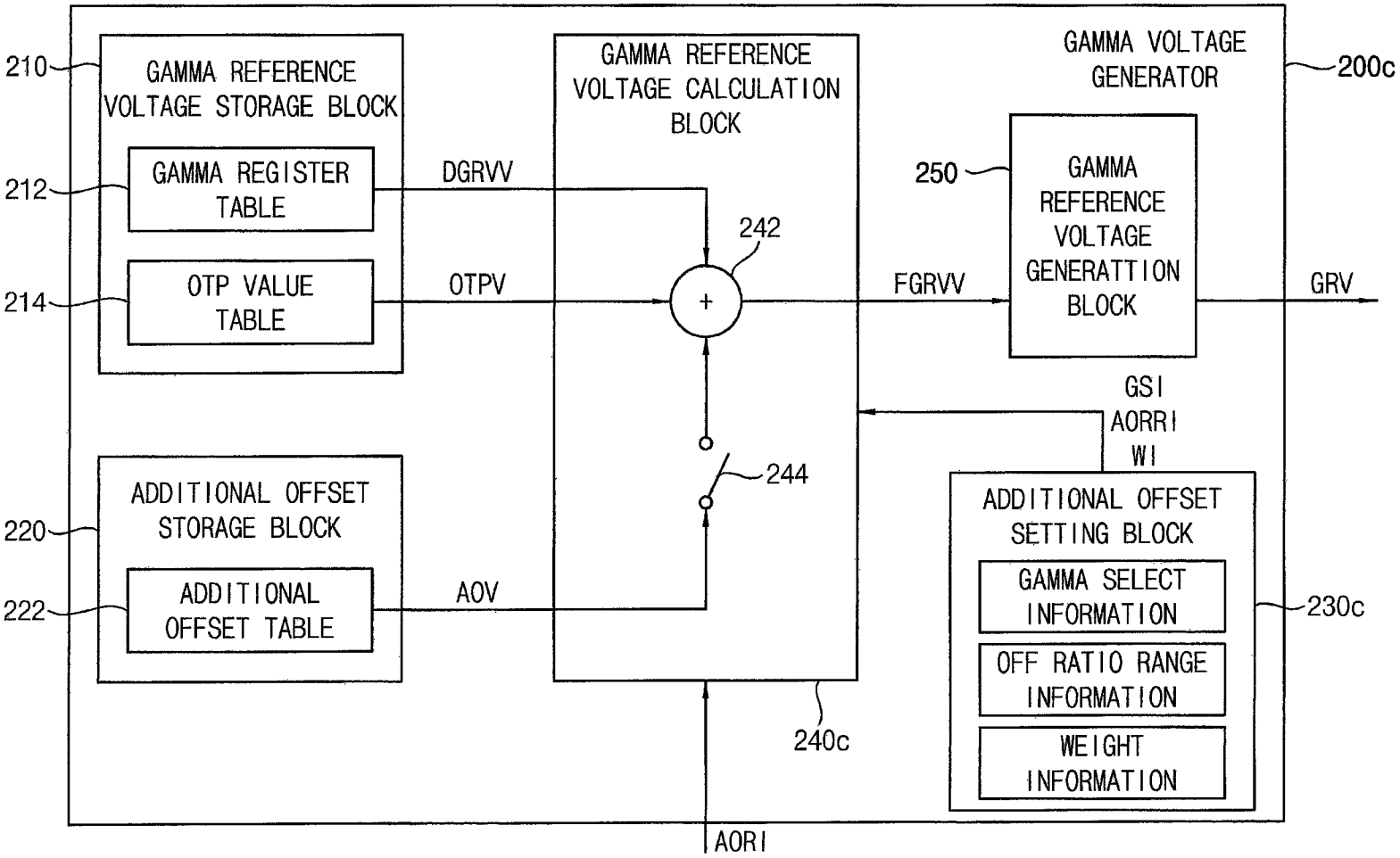
FIG. 10 is a block diagram illustrating a gamma voltage generator according to some example embodiments.

FIG. 10 is a block diagram illustrating a gamma voltage generator according to example embodiments, and FIG. 11 is a diagram for describing an example where additional offset values are applied with different weights depending on an off ratio of a display device.

A gamma voltage generator 200*c* of FIG. 10 may have a similar operation and a similar configuration to a gamma voltage generator 200*b* of FIG. 8, except that an additional offset setting block 230*c* may further store weight information WI.

Referring to FIG. 10, the an additional offset setting block 230*c* may store, as well as gamma select information GSI and/or off ratio range information AORRI, the weight information WI representing weights for additional offset values AOV. When the gamma select information GSI indicates that the additional offset values AOV are to be applied, a gamma reference voltage calculation block 240*c* may multiply the additional offset values AOV by the weights indicated by the weight information WI, and may generate final gamma reference voltage values FGRVV by adding results of the multiplication to gamma reference voltage values (i.e., DGRVV+OTPV) stored in a gamma reference voltage storage block 210.

In some example embodiments, the weight information WI stored in the additional offset setting block 230*c* may include a plurality of weights respectively corresponding to a plurality of off ratios. In this case, the gamma reference voltage calculation block 240*c* may multiply the additional offset values AOV by one of the plurality of weights corresponding to a current off ratio of a display device, and may generate the final gamma reference voltage values FGRVV by adding results of the multiplication to the gamma reference voltage values (i.e., DGRVV+OTPV) stored in the gamma reference voltage storage block 210.

For example, as illustrated in FIG. 11, when the display device may operate at a high luminance level greater than a luminance level (e.g., a predetermined luminance level), or when the display device may operate with an off ratio less than an off ration (e.g. a predetermined off ratio) (e.g., an off ratio less than about 40%), the weight for the additional offset values AOV may be 0, and the gamma reference voltage calculation block 240*c* may output the gamma reference voltage values (i.e., DGRVV+OTPV) stored in the gamma reference voltage storage block 210 as the final gamma reference voltage values FGRVV. When the display device may operate at a luminance level of about 34 nit, or when the display device may operate with an off ratio of about 41%, the weight for the additional offset values AOV may be 0.5, and the gamma reference voltage calculation block 240*c* may calculate values (i.e., 0.5*AOV) by multiplying the additional offset values AOV by the weight of 0.5, and may output the gamma reference voltage values (i.e., DGRVV+OTPV+0.5*AOV) to which the calculated values (i.e., 0.5*AOV) are added as the final gamma reference voltage values FGRVV. Further, when the display device may operate at a low luminance level less than a luminance level (e.g., a predetermined luminance level), or when the display device may operate with an off ratio greater than an off ration (e.g., a predetermined off ratio) (e.g., an off ratio greater than about 75%), the weight for the additional offset values AOV may be 1, and the gamma reference voltage calculation block 240*c* may calculate values (i.e., 1*AOV) by multiplying the additional offset values AOV by the weight of 1, and may output the gamma reference voltage values (i.e., DGRVV+OTPV+1*AOV) to which the calculated values (i.e., 1*AOV) are added as the final gamma reference voltage values FGRVV.

As described above, the gamma voltage generator 200*c* may apply the additional offset values AOV to which different weights are applied according to a luminance level (or a dimming level) or an off ratio, and thus an image quality characteristic of the display device may be further improved.

Figure 12:
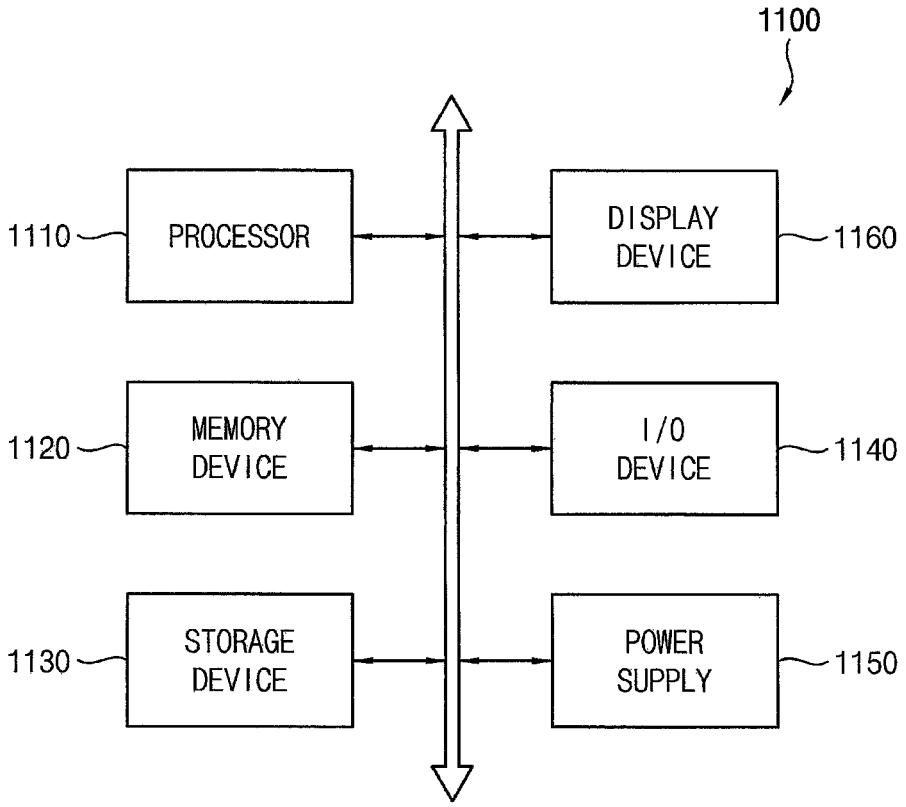
FIG. 12 is a block diagram illustrating an electronic device including a display device according to some example embodiments.

FIG. 12 is a block diagram illustrating an electronic device including a display device according to some example embodiments.

Referring to FIG. 12, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100.

The display device 1160 may store, as well as gamma reference voltage values searched by an MTP operation, additional offset values, may generate gamma reference voltages corresponding to the gamma reference voltage values to which the additional offset values are selectively added depending on gamma select information. Accordingly, even if the display device 1160 is determined as a defective product, the additional offset values may be applied to the display device 1160, and thus the display device 1160 determined as the defective product may be converted into a fair quality product. Therefore, a yield of the display device 1160 can be improved.

According to some example embodiments, the electronic device 1100 may be any electronic device including the display device 1160, such as a cellular phone, a smart phone, a tablet computer, a wearable device, a digital television, a 3D television, a personal computer (PC), a home appliance, a laptop computer, a personal digital assistant (PDA), a portable multimedia player (PMP), a digital camera, a music player, a portable game console, a navigation system, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A gamma voltage generator included in a display device, the gamma voltage generator comprising:

a gamma reference voltage storage block configured to store gamma reference voltage values at reference gray levels;

an additional offset storage block configured to store additional offset values for the gamma reference voltage values at the reference gray levels;

an additional offset setting block configured to store binary gamma select information representing whether the additional offset values are to be applied or not based on whether or not an image quality characteristic corresponds to a target range, wherein the image quality characteristic is at least one of a luminance value or a color coordinate value;

a gamma reference voltage calculation block configured to generate final gamma reference voltage values by selectively adding the additional offset values to the gamma reference voltage values depending on the binary gamma select information; and a gamma reference voltage generation block configured to generate gamma reference voltages corresponding to the final gamma reference voltage values, wherein the additional offset setting block further stores off ratio range information representing an off ratio range of the display device to which the additional offset values are applied, and wherein, in response to the binary gamma select information indicating that the additional offset values are to be applied, and a current off ratio of the display device being within the off ratio range indicated by the off ratio range information, the gamma reference voltage calculation block is configured to generate the final gamma reference voltage values by adding the additional offset values to the gamma reference voltage values, wherein the additional offset storage block includes:

an additional offset table configured to store the additional offset values that are generated by an additional MTP operation for the display device.

2. The gamma voltage generator of claim 1, wherein the gamma reference voltage values stored in the gamma reference voltage storage block are generated by a multi-time programming (MTP) operation at a reference luminance level for the display device.

3. The gamma voltage generator of claim 2, wherein the gamma reference voltage storage block includes:

a gamma register table configured to store default gamma reference voltage values that are common to a plurality of display devices manufactured by a same process as that used for the display device; and an one-time programming (OTP) value table configured to store differences between the default gamma reference voltage values and values searched by the MTP operation.

4. The gamma voltage generator of claim 1, wherein the additional offset storage block includes:

an additional offset table configured to store the additional offset values, and wherein the additional offset values are common to a plurality of display devices manufactured by a same process as that used for the display device.

5. The gamma voltage generator of claim 4, wherein the additional offset values are predetermined to increase blue luminance or green luminance with respect to a defective display device having a reddish defect.

6. The gamma voltage generator of claim 1, wherein the additional offset storage block includes:

an additional offset table configured to store the additional offset values, and wherein the additional offset values are one of a plurality of additional offset value sets that are predetermined for a plurality of display devices manufactured by a same process as that used for the display device.

7. The gamma voltage generator of claim 6, wherein the plurality of additional offset value sets includes a first additional offset value set for increasing blue luminance or green luminance with respect to a defective display device having a reddish defect, and a second additional offset value set for increasing red luminance or green luminance with respect to a defective display device having a bluish defect.

8. The gamma voltage generator of claim 1, wherein the additional MTP operation is performed for each of defective display devices among a plurality of display devices manufactured by a same process as that used for the display device.

9. The gamma voltage generator of claim 1, wherein the additional MTP operation is performed at at least one low luminance level that is lower than a reference luminance level at which an MTP operation for searching the gamma reference voltage values is performed.

10. The gamma voltage generator of claim 1, wherein the additional offset storage block includes:

a reddish defect additional offset table configured to store the additional offset values for increasing blue luminance or green luminance with respect to a defective display device having a reddish defect; and a bluish defect additional offset table configured to store the additional offset values for increasing red luminance or green luminance with respect to a defective display device having a bluish defect.

11. The gamma voltage generator of claim 1, wherein the gamma reference voltage calculation block is configured to output the gamma reference voltage values as the final gamma reference voltage values in response to the binary gamma select information indicating that the additional offset values are not to be applied, and to output the gamma reference voltage values to which the additional offset values are added as the final gamma reference voltage values in response to the binary gamma select information indicating that the additional offset values are to be applied.

12. The gamma voltage generator of claim 1, wherein the gamma reference voltage calculation block includes:

an adder configured to calculate the final gamma reference voltage values; and a switch configured to selectively provide the additional offset values to the adder depending on the binary gamma select information.

13. The gamma voltage generator of claim 1, wherein the additional offset setting block is further configured to store weight information representing weights for the additional offset values.

14. The gamma voltage generator of claim 13, wherein, in response to the binary gamma select information indicating that the additional offset values are to be applied, the gamma reference voltage calculation block is configured to multiply the additional offset values by the weights, and to generate the final gamma reference voltage values by adding results of the multiplication to the gamma reference voltage values.

15. The gamma voltage generator of claim 13, wherein the weight information stored in the additional offset setting block includes a plurality of weights respectively corresponding to a plurality of off ratios, and wherein the gamma reference voltage calculation block is configured to multiply the additional offset values by one of the plurality of weights corresponding to a current off ratio of the display device, and to generate the final gamma reference voltage values by adding results of the multiplication to the gamma reference voltage values.

16. A display device comprising:

a display panel including pixels;

a scan driver configured to provide scan signals to the pixels;

an emission driver configured to provide emission control signals to the pixels;

a gamma voltage generator configured to store gamma reference voltage values and additional offset values, to further store binary gamma select information representing whether the additional offset values are to be applied or not, and to generate gamma reference voltages corresponding to the gamma reference voltage values to which the additional offset values are selectively added depending on the binary gamma select information and based on whether or not an image quality characteristic corresponds to a target range, wherein the image quality characteristic is at least one of a luminance value or a color coordinate value;

a data driver configured to generate data signals based on the gamma reference voltages, and to provide the data signals to the pixels;

an additional offset storage block configured to store the additional offset values for the gamma reference voltage values at reference gray levels, wherein the gamma voltage generator further stores off ratio range information representing an off ratio range of the display device to which the additional offset values are applied, and wherein, in response to the binary gamma select information indicating that the additional offset values are to be applied, and a current off ratio of the display device being within the off ratio range indicated by the off ratio range information, the gamma voltage generator adds the additional offset values to the gamma reference voltage values, wherein the additional offset storage block includes:

an additional offset table configured to store the additional offset values that are generated by an additional MTP operation for the display device.

17. The display device of claim 16, wherein the gamma voltage generator includes:

a gamma reference voltage storage block configured to store the gamma reference voltage values at the reference gray levels;

an additional offset setting block configured to store the binary gamma select information representing whether the additional offset values are to be applied or not;

a gamma reference voltage calculation block configured to generate final gamma reference voltage values by selectively adding the additional offset values to the gamma reference voltage values depending on the binary gamma select information; and a gamma reference voltage generation block configured to generate the gamma reference voltages corresponding to the final gamma reference voltage values.

* * * * *